United States Patent [19]

Schluter

[11] 4,449,663

[45] May 22, 1984

[54] MAILBOX SIGNAL DEVICE

[76] Inventor: Harry C. Schluter, 94 Piney Ridge Dr., Hendersonville, N.C. 28739

[21] Appl. No.: 533,757

[22] Filed: Sep. 19, 1983

[51] Int. Cl.[3] ..... B65D 91/00; A47G 29/12

[52] U.S. Cl. ..... 232/35

[58] Field of Search ..... 232/34, 35, 37, 38

[56] References Cited

U.S. PATENT DOCUMENTS

| | | | |
|---|---|---|---|
| 1,562,536 | 11/1925 | Berg | 232/34 |
| 2,859,913 | 11/1958 | Paschke et al. | 232/35 |
| 3,034,706 | 5/1962 | Wing | 232/34 X |
| 4,202,486 | 5/1980 | Tipsword | 232/35 |
| 4,390,122 | 6/1983 | Savko | 232/35 |

*Primary Examiner*—Robert P. Swiatek

*Attorney, Agent, or Firm*—McCormick, Paulding & Huber

[57] ABSTRACT

An auxiliary signal device for a mailbox includes a signal flag pivotally supported on a bracket mounted near the rear of the mailbox. An operating rod connected to another bracket mounted on the mailbox door cams the signal flag and catapults it to a raised position when the door is opened. A detent retains the signal flag in its raised position until it is lowered by manually operating a lowering rod. The signal device is attached to a mailbox by bending mounting tabs on the brackets into engagement with associated surfaces of the mailbox.

10 Claims, 8 Drawing Figures

MAILBOX SIGNAL DEVICE

BACKGROUND OF THE INVENTION

This invention relates in general to signal devices for letter boxes and deals more particularly with an improved auxiliary door operated sight signal device for attachment to a rural mailbox.

In rural areas mailboxes are usually located a substantial distance from the homes which they serve. Consequently, a boxholder may be required to walk a substantial distance to check his mailbox, often only to find that it is empty. Rural mail routes are planned, relative to the flow of traffic, so that in many instances all of the mailboxes along a route may be located along one side of the road. This arrangement presents potential hazards for the residents living on the opposite side of the road who must cross the road to pick up mail.

In accordance with postal regulations, each rural mailbox is provided with a standard red signal flag which may be raised by the postal patron as a signal to the mail carrier to pick up mail left in the box. The mail carrier is required to lower the red signal flag after collecting the mail from the box, but is not permitted to operate any other auxiliary signal device which may be provided. When mail has been left in the box for pick up by the mail carrier, the postal patron may determine, by the position of the red signal flag, whether the box has been serviced. However, if the red signal flag has not been raised to signal the carrier to pick up mail, the box-holder must inspect the mailbox to determine if mail has been delivered.

Heretofore, various door operated auxiliary mailbox signalling devices have been provided for indicating when the door of a mailbox has been opened. However, it is the practice of many rural carriers to ony partially open the door of a mailbox when only a small amount of mail is to be deposited. Consequently, many of these devices are not entirely satisfactory, because the door of the mailbox may not be opened a sufficient amount to assure proper operation of the device. Further, when the box-holder picks up his mail, he must reset the signal device so that it will operate properly the next time the mailbox door is opened. Many of the signal devices heretofore available cannot be easily reset from a position in front of the mailbox. This arrangement is most inconvenient for the box holder who prefers to pick up his mail without leaving his car.

Other auxiliary signal devices heretofore available have proven difficult to install on a mailbox and have required special tools to effect installation.

Accordingly, it is the general aim of the present invention to provide an improved auxiliary door operated mailbox signal device which will operate in response to partial opening of a mailbox door. It is a further aim of the invention to provide an improved automatic signalling device which may be readily reset from a position in front of a mailbox so that it may be operated from a drive-up position by a person seated in a motor vehicle. A further aim of the invention is to provide an improved door operated device of simple durable construction for low cost manufacture and which may be installed on a mailbox by a person of ordinary skill and without the use of special tools.

SUMMARY OF THE INVENTION

In accordance with the invention, a door operated sight signal device is provided for attachment to a mailbox which includes a horizontally elongated mail receptacle closed at its rear end and having a door hingedly connected to its front end for pivotal movement about a horizontal axis between open and closed positions. The cover in its closed position forms a closure for the front end of the mail receptacle. The signal device comprises a rear bracket for mounting at the rear and adjacent an associate side of the mail receptacle and front bracket for mounting on the cover. Mounting tabs on the brackets bent into engagement with associated portions of the mailbox maintain the brackets in fixed position thereon. The rear bracket has an elongated guide slot formed therein. A signal member supported on the rear bracket for pivotal movement between an inactive position and a signalling position has a cam surface thereon. When the signal member is in its inactive position one portion of the cam surface extends transversely across an elongated guide slot. Another portion of the cam surface extends in generally parallel relation to the guide slot when the signal member is in its signalling position. A rigid operating rod pivotally connected at its forward end to the front bracket has a camming portion at its rear end received within the slot for engaging the cam surface. Initial opening movement of the mailbox door causes a corresponding movement of the guide rod which cams the signal member and catapults it to its signalling position.

DETAILED DESCRIPTION OF PREFERRED EMBODIMENT

Figure 1:
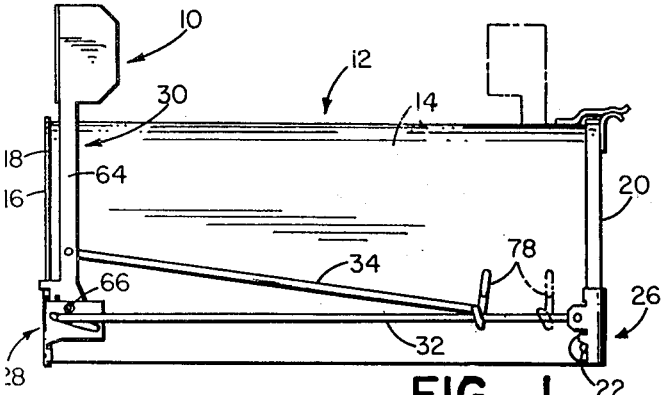
FIG. 1 is a side elevational view of a rural mailbox having a sight signal device embodying the present invention mounted thereon.

Turning now to the drawings, an auxiliary mailbox signal device embodying the present invention and indicated generally by the reference numeral 10 is shown attached to a rural mailbox, indicated generally at 12. The mailbox 12 is of a type approved by the Postmaster General, and conforming with United States Postal Regulations and includes a horizontally elongated mail receptacle 14 which has a rear wall 16. The rear wall is joined to the top and side walls of the receptacle by a bead which forms an outwardly directed flange 18, best shown in FIG. 3, and which extends around the top and downwardly along the rear sides of the receptacle. A cover or door 20 connected to the lower front end of the receptacle is pivotally movable about a horizontal axis 22 between open and closed positions. The door has a rearwardly directed marginal flange 24 which extends around its top and downwardly along its sides. The flange 24 overlies an associated front marginal portion of the receptacle 14 when the door 20 is in its closed position to form a substantially weather-tight closure for the receptacle. A standard red signal flag, shown in broken lines in FIG. 1, is mounted on the right side of the mailbox 12, as viewed from the front or door end.

The signal device 10 is shown connected to the left side of the mailbox 12 and includes a front bracket, indicated generally at 26, secured in fixed position to the door 20 and a rear bracket, designated generally by the numeral 28, secured in fixed position to the lower rear end portion of the receptacle 14. A signal member or flag, indicated generally at 30, is pivotally connected to the rear bracket 28 for movement between a lowered or inactive position, shown in broken lines in FIGS. 2 and 4, and a raised or signally position shown in full lines in FIGS. 1, 2 and 4. The device 10 further includes an operating rod 32 connected to the front bracket 26 for raising the signal flag 30 to its signalling position in response to opening movement of the door 20. The illustrated device also includes a lowering rod 34 for manually releasing the signal flag 30 from its signalling position, all of which will be hereinafter more fully described.

Figure 5:
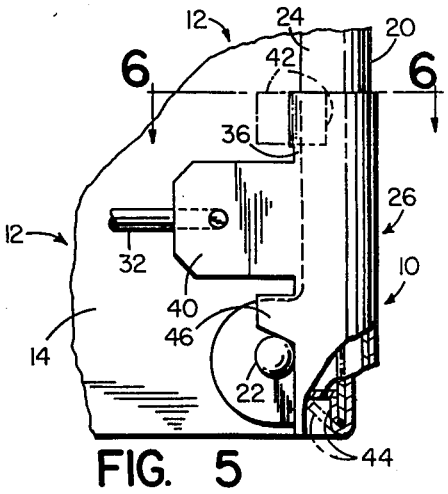
FIG. 5 is a somewhat enlarged fragmentary side elevational view of a front portion of the mailbox assembly shown in FIG. 1.
Figure 6:
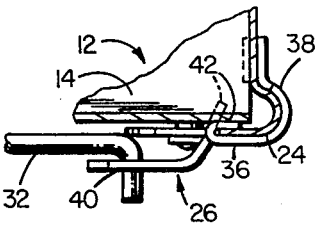
FIG. 6 is a fragmentary sectional view taken along the line 6—6 of FIG. 5.

Considering the signal device 10 in further detail, the front bracket 26 is preferably formed from flat metal and has a body portion 36 which overlies an associated portion of the marginal flange 24, as best shown in FIGS. 5 and 6. The front margin of the body portion is contoured to overlie and complement an associated front marginal portion of the door 20, as best shown in FIG. 6, where the front marginal portion is indicated by the numeral 38. The front bracket 26 further includes a rearwardly projecting portion 40 which is laterally outwardly offset from the body 36, as shown in FIG. 6. The front bracket 26 is secured in fixed position to the door 20 by integral mounting tabs 42 and 44 which are bent into engagement with the door 20 when the bracket is installed on the door. The upper mounting tab 42 is bent from its broken line or preassembly position to a position wherein it bears against the inner surface of the flange 24, as shown in full lines in FIG. 6. The lower mounting tab 44 serves to properly locate the bracket and is bent upwardly from its broken line or preassembly position to its full line position of FIG. 5 wherein it bears against the inner side of the door 20 at its lower edge. When the bracket 26 is assembled with the door 20 a rearwardly extending tab 46 on the bracket rests against the door pivot fastener, which defines the pivot axis 22, to prevent downward movement of the bracket relative to the door.

Figure 3:
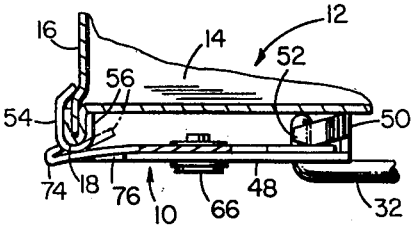
FIG. 3 is a sectional view taken along the line 3—3 of FIG. 2.

The rear bracket 28 is also preferably formed from flat metal and has a generally rectangular body portion 48 maintained in spaced parallel relation to the left side of the receptacle 14 by an integral vertically disposed front portion 50 which is bent laterally inwardly toward the receptacle 14 and rests against an associated portion of the left side of the receptacle, as best shown in FIG. 3. The front marginal portion 50 has an upper part 52 which is separated from the body portion 48 and which is bent rearwardly and downwardly in laterally spaced relation to the body portion of the bracket 28. An integral vertically extending rear marginal portion 54 extends above and below the body portion 48 and is bent laterally inwardly toward the receptacle to overlie associated portions of the flange 18 and the rear wall 16, as best shown in FIG. 3. Mounting tabs 56 and 58, integrally formed on the rear marginal portion 54 above and below the body portion 48 are bent rearwardly from preassembly positions to positions of gripping engagement with the flange 18 to secure the bracket 28 in fixed position adjacent the left rear side of the receptacle 14, substantially as shown. A forwardly projecting locating tab 60 at the lower end of the rear marginal portion 54 engages the lower edge of the rear wall 16 and aids in locating the bracket 28 relative to the receptacle during assembly. The bracket 28 has a forwardly and downwardly inclined slot 62 formed in its body portion 48, for a purpose which will hereinafter be evident.

The signal flag 30 is preferably formed from flat metal and has an elongated staff 64 reinforced by an integral formed rib which extends longitudinally of the staff. One end portion of the staff is connected to the bracket 28 by a pivot pin or rivet 66 located above a central portion of the slot 62. At its other end the staff 64 carries a flag, which is preferably bright fluorescent yellow for high visibility. The flag is preferably formed by two angularly related portions so that it is clearly visible when viewed from any angle.

Figure 4:
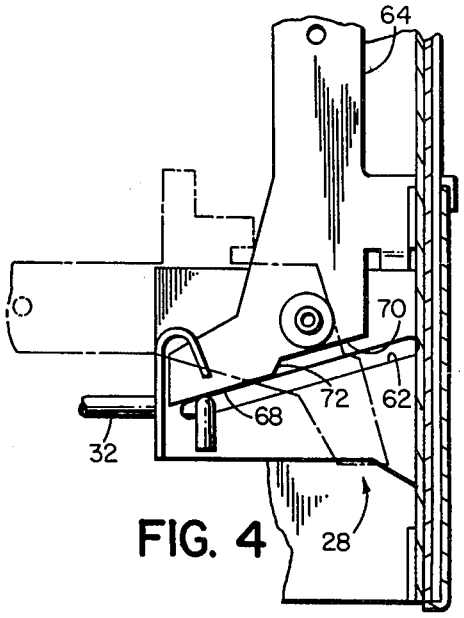
FIG. 4 is a fragmentary side elevational view of the rear bracket and signal member of FIG. 2, as viewed from its inner side.
Figure 2:
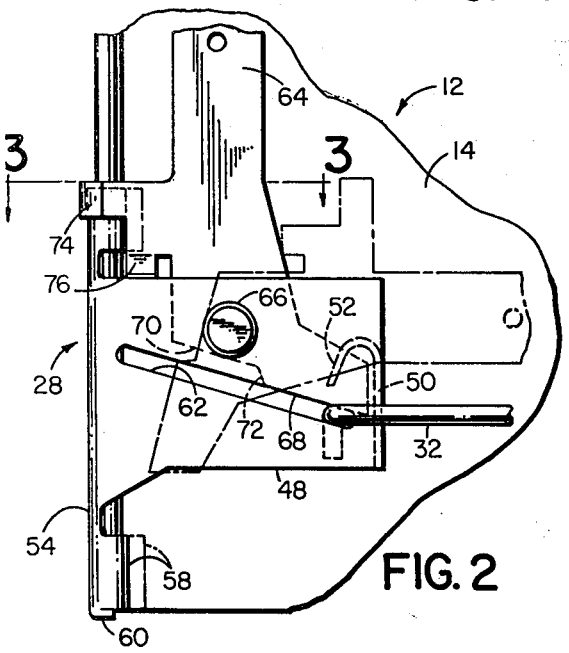
FIG. 2 is a somewhat enlarged fragmentary side elevational view of a rear portion of the mailbox assembly shown in FIG. 1.

Considering the signal flag 30 in its raised position, and referring particularly to FIGS. 2 and 4, the staff 64 has a downwardly facing cam surface at its lower end defined by its lower edge and located below the pivotal axis of the staff. A forward portion of the cam surface is indicated at 68 and is in registry with the upper edge portion of the slot 62. The cam surface further includes a rear portion 70 which is spaced above and generally parallel to the upper edge portion of the slot 62 when the signal flag is in its raised position. An intermediate portion of the cam surface, indicated by the numeral 72 and located slightly forward of the signal flag pivot axis, is upwardly and rearwardly inclined from the front portion 68 to the rear portion 70 and provides transition therebetween. When the signal flag 30 is in its lowered position, the cam surface extends across the slot 62.

The illustrated signal flag 30 further includes a detent tab 74 which extends rearwardly from the staff 64 and has an inwardly extending projection at its free end for snap-over engagement with an upper end part of the rear marginal portion 54. The detent tab 74 serves to releasably retain the signal flag in its raised position. The signal flag 30 also has a limit stop tab 76 located rearwardly of its pivotal axis and bent laterally outward into vertical alignment with the bracket body portion 48. When the signal flag 30 attains its raised position, as it appears in full lines in FIG. 2, the lower edge of the tab 76 engages the upper edge of the body portion 48 to prevent further counterclockwise movement of the signal flag about its axis as it appears oriented in FIG. 1.

The operating rod 32 has an L-shaped forward end portion which is engaged for pivotal movement within an aperture in the set portion of the front bracket 26, as shown in FIGS. 5 and 6. The rear end portion of the operating rod 32 is bent inwardly through the slot 62 and downwardly relative to the inner surface of the body portion 48 whereby it is retained within the slot 62. When the mailbox door 20 is in its closed position the rear end portion of the operating rod 32 is disposed in the rear portion of the slot 62 and the signal flag 30 is in its lowered position.

The rear end portion of the flag lowering rod 34 is pivotally connected to the staff 64 above its pivotal axis. The forward end portion of the flag lowering rod is looped around the operating rod 32 for free sliding movement therealong and has an upwardly projecting portion which defines an operating handle indicated by the numeral 78 in FIG. 1.

When the signal flag 30 is in its lowered position, opening movement of the door 20 causes the rear end or camming portion of the operating rod 32 to engage the cam surface on the signal flag. The cam surfaces on the signal flag are constructed and arranged relative to the slot 62 so that relatively slight forward movement of the operating rod 32 causes substantial pivotal movement of the signal flag in a counterclockwise direction toward its signalling position, as it appears in FIG. 1. Normal movement of the door 20 to a partially opened position causes the signal flag 30 to be catapulted toward its signalling position. When the camming portion of the operating rod 32 engages the cam surface portion 68, the signal flag 30 will be positively set in its raised or signalling position wherein the detent tab 74 is engaged in its detaining position, as it appears in FIGS. 2 and 3.

After mail has been deposited in the mailbox 12, the mail carrier will close the door 20, which returns the operating rod 32 to its normal operating position. The signal flag 30, will however, remain in its raised position, being held in the latter position by the detent tab 74.

After the mail has been removed from the mailbox the handle 78 is moved from its full line toward its broken line position of FIG. 1. Initial forward movement of the handle 78 causes a corresponding clockwise angular movement of the signal flag 30 about its axis which releases the detent tab 74. Thereafter, the signal flag 30 is free to rotate in clockwise direction from its position of FIG. 1 to its lowered position under the influence of gravity.

The procedure for installing the signal device 10 is quite simple and requires only a pliers for bending the various operating tabs into gripping engagement with the mailbox. The handle 78 is conveniently positioned near the front end of the mailbox so that it is readily accessible to one picking up mail from a vehicle.

Figure 7:
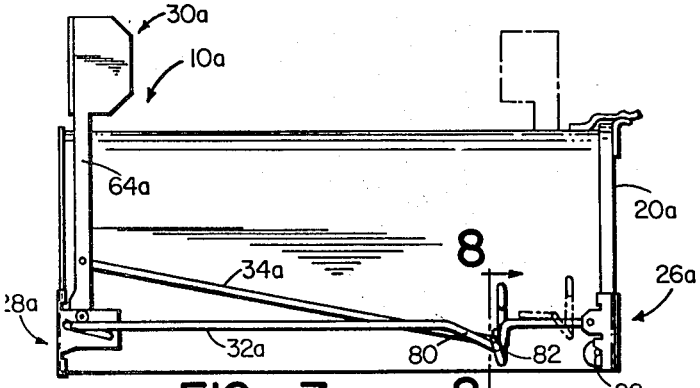
FIG. 7 is similar to FIG. 1 but illustrates another embodiment of the invention.
Figure 8:
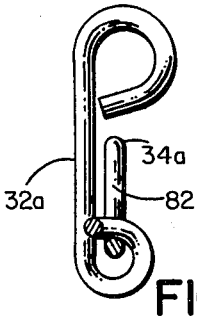
FIG. 8 is a somewhat enlarged fragmentary sectional view taken along the line 8—8 of FIG. 7.

Referring now to FIG. 7, another signal device embodying the present invention is indicated generally at **10*a*. The signal device 10*a* is similar in most respects to the device 10 previously described and differs therefrom only in the arrangement of the detent which retains the signal flag in its signalling position. Parts of the device 10*a*** which are similar or substantially identical to parts previously described bear the same reference numerals as the previously described parts and a letter "a" suffix and will not be hereinafter further described.

The operating rod **32*a* has a downwardly bent generally V-shaped portion 80 which includes a rearwardly facing surface 82. The flag lowering rod 34*a* is dimensioned so that the looped portion at its forward end which encircles the operating rod 32*a* is disposed within the V-shaped portion 80 when the signal flag 30 is in its raised position. It will also be noted that the radial distance from the pivotal axis of the signal flag 30*a* to the pivotal axis of the lowering rod 34*a* is somewhat greater than the corresponding radial distance between the latter connections of the device 10**.

Opening movement of the door **20*a* catapults the flag 30*a* to its raised position, as previously described. While the door 20 is in an open position, the camming portion of the operating rod 32*a* is engaged by the forward portion of the cam surface whereby the signal flag 30 is retained in its raised position, which makes it unnecessary to provide a detent tab, such as the previously described tab 74. As the door 20*a* is moved toward its closed position, the flag remains in its raised position due to the cooperative engagement of the cam surface on the lower end of the signal flag staff and the camming portion at the rear of the operating rod 32*a*. The flag lowering rod 34*a* is dimensioned so that the looped forward end portion of the rod will drop into the V-shaped portion 80 when the signal flag reaches its fully raised or signalling position at which time the looped portion of the lowering rod 34*a* engages the rearwardly facing surface 82. Thus, final angular movement of the door 20*a* to its closed position sets the signal flag 30*a* in its raised position. After mail is picked up, the flag is lowered by releasing the lowering rod 34*a* from engagement within the V-shaped portion 80 of the operating rod 32*a*** which allows the signal flag to pivot to its lowered position under the influence of gravity.

I claim:

1. A signal device for attachment to a mailbox having an elongated mail receptacle closed at its rear end and a door hingedly connected to the mail receptacle at its front end for pivotal movement about a horizontal axis between open and closed position, the door in its closed position forming a closure for the front end of the mail receptacle, said signal device comprising a rear bracket for mounting on the mail receptacle and having an elongated slot therein, means for mounting said rear bracket in fixed position on said receptacle, a signal member pivotally supported on said rear bracket for movement between an inactive position and a signalling position and having a cam surface thereon, said cam surface extending transversely of said slot when said signal member is in its inactive position and extending in generally parallel relation to said slot when said signal member is in its signalling position, a front bracket, mounting means for securing said front bracket in fixed position to the door to move therewith, operating means for moving said signal member from its inactive position to its signalling position in response to movement of the door toward its open position and including an operating rod having one end portion connected to said front bracket and an opposite end extending through said slot to travel within said slot and cammingly engage said cam surface, and detent means for releasably securing said signal member in its signalling position.

2. A signal device for attachment to a mailbox as set forth in claim 1 wherein said signal member includes a signal flag having a staff pivotally supported on said rear bracket above said slot and movable between a lowered position corresponding to said inactive position and a raised position corresponding to said signalling position and said cam surface is defined by the lower edge of said staff in its raised position.

3. A signal device as set forth in claim 2 wherein said detent means comprises a detent surface on said rear bracket and a detent tab on said signal flag engageable with said detent surface when said signal flag is in its raised position.

4. A signal device as set forth in claim 2 including manually operable means for moving said signal flag from its raised position including a lowering rod having one end connected to said staff in spaced relation to the pivot axis of said staff and an opposite end supported for movement along said operating rod.

5. A signal device as set forth in claim 4 wherein said operating rod comprises said detent means.

6. A signal device as set forth in claim 5 wherein said operating rod has a generally V-shaped upwardly opening portion formed therein defining a rearwardly facing surface and said opposite end of said lowering rod is engaged with said rearwardly facing surface when said signal flag is in its raised position and detains said signal flag in its signalling position.

7. A signal device as set forth in claim 1 wherein said mounting means comprises mounting tabs on said front bracket and said rear bracket bendable into gripping engagement with associated surfaces of the mailbox.

8. A signal device as set forth in claim 7 wherein said device includes positioning means for locating said front bracket and said rear bracket in predetermined position relative to the mailbox during assembly of said device with the mailbox.

9. A signal device as set forth in claim 8 wherein said positioning means comprises at least one of said mounting tabs.

10. A signal device as set forth in claim 1 wherein said device includes positioning means for locating said front bracket and said rear bracket in predetermined position relative to the mailbox during assembly of said device with the mailbox.

* * * * *